US006158068A

United States Patent [19]

Pariseau

[11] Patent Number: 6,158,068

[45] **Date of Patent: *Dec. 12, 2000**

[54] COMBINED SLEEPING BAG AND ACTIVITY SURFACE

[75] Inventor: Dean Pariseau, Southbridge, Mass.

[73] Assignee: Seneca Sports Inc., Milford, Mass.

[ * ] Notice: This patent is subject to a terminal disclaimer.

[21] Appl. No.: 09/550,378

[22] Filed: Apr. 14, 2000

Related U.S. Application Data

[63] Continuation of application No. 09/374,171, Aug. 13, 1999.

[51] Int. Cl.[7] ..... A47C 29/00

[52] U.S. Cl. ..... 5/413 R; D2/719

[58] Field of Search ..... 5/413 R, 413 AM, 5/482, 655, 502; D2/718, 719; D6/597, 603; 2/69, 69.5; 446/75

[56] References Cited

U.S. PATENT DOCUMENTS

| | | | |
|---|---|---|---|
| D. 230,539 | 3/1974 | Aires | D6/547 |
| D. 263,543 | 3/1982 | Daugmerty | D6/597 |
| D. 313,142 | 12/1990 | Trvell | D6/603 |
| D. 365,486 | 12/1995 | Perry | D6/597 |
| 1,269,276 | 6/1918 | Harris | 5/490 |
| 3,120,721 | 2/1964 | Bukatman et al. | 5/482 |
| 4,236,263 | 12/1980 | Allee | 5/413 R |
| 4,875,245 | 10/1989 | Isola | 5/482 |
| 4,972,533 | 11/1990 | Brown | 5/413 R |
| 5,548,858 | 8/1996 | Shao | 5/413 R |

*Primary Examiner*—Alexander Grosz
*Attorney, Agent, or Firm*—Cesari and McKenna

[57] ABSTRACT

A sleeping bag formed with an outer case having an exposed surface and a coextensive tensive liner having an exposed surface, the case and liner being secured together along their edges to form a pad which may be folded in half and releasably secured along the bottom and side of the pad opposite the fold. The exposed surface of the liner bears indicia representing a selected game board or field and the exposed surface of the outer case carries a design whose motif is suggestive of the activity surface which becomes visible when the bag is unfolded.

2 Claims, 1 Drawing Sheet

COMBINED SLEEPING BAG AND ACTIVITY SURFACE

RELATED APPLICATION

This application is a continuation of Ser. No. 09/374,171, filed Aug. 13, 1999.

This invention relates generally to bedding. It relates more specifically to a sleeping or slumber bag which is particularly adapted for use by children.

BACKGROUND OF THE INVENTION

A conventional sleeping bag usually comprises an outer case and a coextensive inner liner. The case and liner are secured together along their edges with the space between those layers being filled with insulation or padding of one kind or another to form a pad. Usually, mating zipper slides are secured to the side and bottom edges of the pad so that when the pad is folded in half from side to side, a zipper slider may be pulled along the slides to join the slides to form the sleeping bag which may be entered through the opening at the head of the bag.

Sleeping bags have become increasingly popular with children both for home use, travel and for overnight visits with friends and family. Manufacturers of children's sleeping bags have made use of familiar toy and cartoon characters which are brightly displayed or printed on the outer case of the sleeping bags to both attract attention and to make the sleeping bags more endearing to the children.

Invariably however, the inner liners of conventional sleeping bags are plain, undecorated layers of flannel material or the like. While the color of the liner may be coordinated with the color of the case, no attempt is made to include indicia, printing, graphics, designs, displays or anything else on the surface of the liner which is exposed when the sleeping bag is laid open on the outer case thereof.

SUMMARY OF THE INVENTION

Accordingly, it is an object of the present invention to provide an improved sleeping or slumber bag designed especially for children.

Another object of the invention is to provide a sleeping bag of this type whose liner may be used as an activity surface when the bag is laid open on the outer case of the sleeping bag.

A further object of the invention is to provide a sleeping bag whose outer case and liner carry designs or displays having a common theme on their exposed surfaces.

Another object of the invention is to provide a sleeping bag whose liner may function as a playing surface or game field for various movable activity pieces or elements.

Yet another object of the invention is to provide a sleeping bag of the foregoing type whose liner activity surface or field is coordinated with the design motif on the sleeping bag's outer case.

Other objects will, in part, be obvious and will, in part appear hereinafter.

The invention accordingly comprises the features of construction, combination of elements and arrangement of parts which will be exemplified in the following detailed description, and the scope of the invention will be indicated in the claims.

Briefly, my sleeping bag is structurally more or less conventional comprising an outer case and a substantially congruent inner liner stitched together around their perimeters and folded laterally and with their free edges being releasably secured together to form a bag whose interior is accessible at the head of the bag. When the bag is opened on the outer case, it forms a flat pad.

The present sleeping bag differs from conventional sleeping bags, however, in that the exposed surface of the bag liner carries indicia specifically coordinated with a design motif expressed on the outer or exposed surface of the case. When the bag is opened and laid flat as a pad, the liner may function as an activity surface or game field for children sitting on the pad. When the article is in the form of a sleeping bag, the coordinated design on the exterior surface of the bag provides an indication or advertisement of the type of activity surface or field available to the child when their sleeping bag is opened to form the pad. Thus, substantially all exposed surfaces of the bag present a unitary theme.

As will become apparent, various activity or playing surfaces may be applied to the liner that are coordinated with decorations on the outer casing so that a wide variety of different sleeping bag themes are possible.

The cost to make the present sleeping bag in quantity is not appreciably more than the cost to produce a conventional sleeping bag. Yet, this bedding item should provide more enjoyment for the child using the bag. Therefore, it should prove to be a popular and marketable product.

BRIEF DESCRIPTION OF THE DRAWING

For a fuller understanding of the nature and object of the invention, reference should be had to the following detailed description, taken in connection with the accompanying drawing, in which.

DETAILED DESCRIPTION OF AN ILLUSTRATIVE EMBODIMENT

Figure 1:
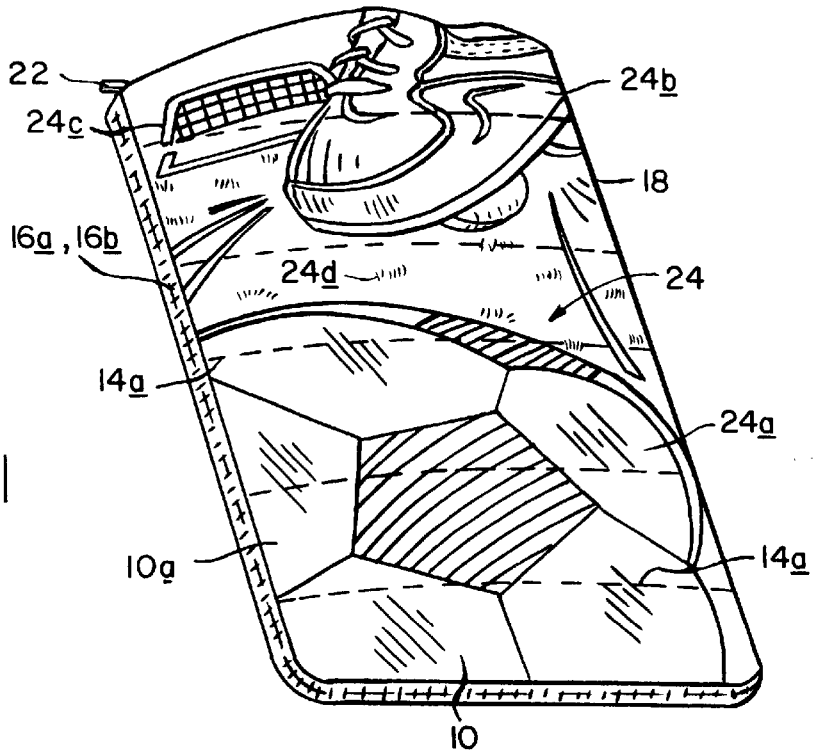
FIG. 1 is a perspective view of a closed sleeping bag incorporating the invention.
Figure 2:
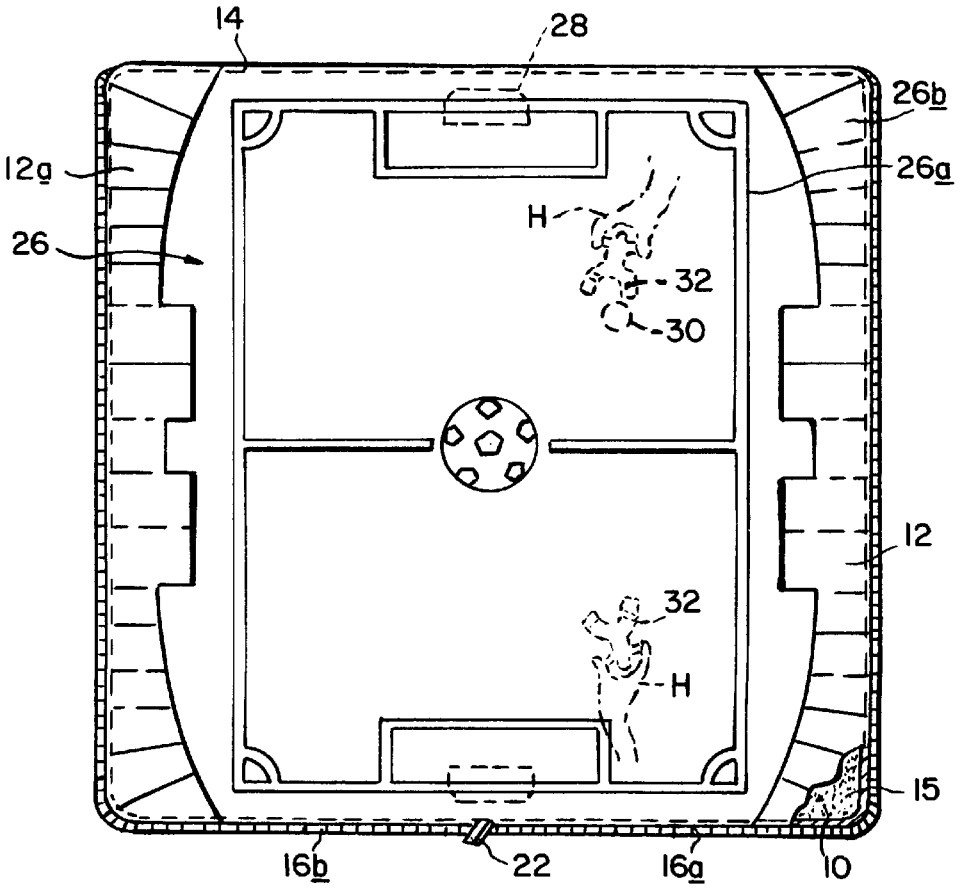
FIG. 2 is a plan view of the FIG. 1 bag opened up to form a flat pad having an exposed activity surface.

Referring to FIGS. 1 and 2 of the drawing, the present sleeping bag comprises an outer generally rectangular layer or case 10 of a suitable water-resistant sheet material and a coextensive inner rectangular layer or liner 12 preferably of a nappy material such as flannel. The two layers are connected together around their perimeters by stitching 14 to form a two-layer panel. The air space between the layers 10 and 12 provides a certain amount of insulation. If additional insulation is required, conventional insulating material or padding 15 may be inserted between the layers as shown in FIG. 2 and held in place by additional stitching 14*a* extending across the panel at spaced apart locations thereon.

Zipper slides 16*a* and 16*b* are secured by stitching 14 to the opposite side edges of the panel and to the bottom of the panel on opposite sides of the vertical centerline thereof so that when the panel is folded along its vertical centerline, the panel slides 16*a* and 16*b* may be joined together by a zipper slider 22 to form the sleeping bag illustrated in FIG. 1. Access to the interior of the bag is had through the open head of the bag. Thus, from a structural standpoint, the illustrated bag is quite similar to conventional sleeping or slumber bags. Of course, other fastener means such as hook and loop fasteners, snap fasteners, etc. may be used in lieu of a zipper to form the bag.

The present sleeping bag differs from prior bags of this general type in that the outer exposed surface 10*a* of case 10 carries a design shown generally at 24 having a selected motif. In the illustrated bag, design 24 includes a representation of a soccer ball 24*a*, a foot 24*b* and a soccer goal 24*c* superimposed on a grass background 24*d*. FIG. 1 shows only the upper portion of the case surface 10*a*. The same theme is expressed on the remaining portion of surface 10*a* not shown in FIG. 1.

As best seen in FIG. 2, according to a further aspect of the invention, the exposed surface 12*a* of liner 12 is also provided with design indicia shown generally at 26 specifically coordinated with the aforesaid design 24. In the illustrated sleeping bag, indicia 26 represent a soccer stadium comprising a soccer field 26*a* surrounded by viewing stands 26*b*. Thus, when the sleeping bag is opened up and laid flat on its outer case 10 as shown in FIG. 2, the exposed surface 12*a* of liner 12 forms a playing surface or field for a simulated soccer game.

If desired, appropriate free standing play pieces may be used in conjunction with the sleeping bag. Thus, as shown in phantom in FIG. 2, goals 28 may be positioned at opposite ends of the soccer field 26*a* and a miniature soccer ball 30 may be moved over the playing field by hand-held "players" 32 manipulated by the players hands H.

While the illustrated sleeping bag has a soccer motif, it should be obvious that sleeping bags such as this may carry a wide variety of different themes or designs 24, 26. For example, a design 24 of a knight on horseback may signal that the indicia 26 is a simulated chessboard. A football motif on the outer surface 10*a* of the bag might indicate the presence of a miniature football field design on the liner surface 12*a* on which a simulated game of football may be played with miniature football and goal posts play pieces. In another variation, a design with a watermelon motif on the outer case may be accompanied by indicia 26 on the inner liner representing a picnic area including a table upon which children may eat snacks, perhaps using a toy tea set. For still another sleeping bag theme, the outer case may bear the resemblance of a licensed property such as Mario Andretti and the inner liner may carry the outline of a race track on which toy cars may be maneuvered. Any number of inner and outer design possibilities may be envisioned. The key lies in the coordinating of the normally hidden activity surface on the inside of the sleeping bag with the design motif on the outer casing so that when the bag is zippered up as shown in FIG. 1, an observer will receive a hint of the type of activity surface or game field present on the hidden inner lining that will become accessible and available when the sleeping bag is opened up and laid flat as shown in FIG. 2.

The design 24 and indicia 26 may be printed, embroided, woven or otherwise permanently incorporated into layers 10 and 12 so as to be visable on surfaces 10*a* and is 12*a*.

It is apparent from the above that the present sleeping bag has utility both as a sleeping bag and as an activity or playing surface to be enjoyed by the child using the bag and his/her playmates. Furthermore, a sleeping bag incorporating the invention should be quite marketable since the exterior design motif on the bag functions as an advertisement at the point of sale for the activity surface or game field within.

It will thus be seen that the objects set forth above, among those made apparent from the preceding description, are efficiently attained. Also, since certain changes may be made without departing from the scope of the invention, it is intended that all matter contained in the above description or shown in the accompanying drawing, shall be interpreted as illustrative and not in a limiting sense.

It is also to be understood that the following claims are intended to cover all of the generic and specific features of the invention described herein.

What is claimed is:

1. In a sleeping bag of the type including an outer case having an exposed surface and a superimposed coextensive liner having an exposed surface, said outer case and liner being secured together to form a pad which may be folded in half and releasably secured along the bottom and side of the pad opposite the fold, the improvement wherein the exposed surface of the liner has indicia representing a selected game board or field and the exposed sutton of the outer case carries a design whose motif is suggestive of said game board or field and which becomes visible only when the bag is unfolded whereby said bag has utility both as bedding and as an game board or field.

2. The sleeping bag defined in claim 1 and further including one or more free standing play pieces associated with and manipulatable on said game board or field.

* * * * *